US008348649B2

(12) United States Patent
Miyamura et al.

(10) Patent No.: US 8,348,649 B2
(45) Date of Patent: Jan. 8, 2013

(54) SINGLE SCREW COMPRESSOR AND A METHOD FOR PROCESSING A SCREW ROTOR

(75) Inventors: Harunori Miyamura, Osaka (JP); Tadashi Okada, Osaka (JP); Takayuki Takahashi, Osaka (JP); Kaname Ohtsuka, Osaka (JP); Toshihiro Susa, Osaka (JP); Hiromichi Ueno, Osaka (JP); Takanori Murono, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 562 days.

(21) Appl. No.: 12/672,248

(22) PCT Filed: Aug. 7, 2008

(86) PCT No.: PCT/JP2008/002157
§ 371 (c)(1),
(2), (4) Date: Feb. 4, 2010

(87) PCT Pub. No.: WO2009/019882
PCT Pub. Date: Feb. 12, 2009

(65) Prior Publication Data

US 2011/0097232 A1 Apr. 28, 2011

(30) Foreign Application Priority Data

Aug. 7, 2007 (JP) ..... 2007-205778

(51) Int. Cl.

| | |
|---|---|
| ***F01C 1/08*** | (2006.01) |
| ***F01C 1/24*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F16N 13/20*** | (2006.01) |

(52) U.S. Cl. ..... 418/195; 418/194; 418/196; 418/197; 418/198

(58) Field of Classification Search ..... 418/194–198
See application file for complete search history.

(56) References Cited

U.S. PATENT DOCUMENTS

| | | | | |
|---|---|---|---|---|
| 3,133,695 | A * | 5/1964 | Zimmern | 418/87 |
| 3,181,296 | A * | 5/1965 | Zimmern | 60/39.63 |
| 3,551,082 | A * | 12/1970 | Zimmern | 418/195 |
| 3,708,249 | A * | 1/1973 | Luthi | 417/203 |
| 3,752,606 | A * | 8/1973 | Zimmern | 418/97 |
| 3,874,828 | A * | 4/1975 | Herschler et al. | 418/87 |

(Continued)

FOREIGN PATENT DOCUMENTS

JP 60-17284 A 1/1985

(Continued)

*Primary Examiner* — Kenneth Bomberg
*Assistant Examiner* — Dapinder Singh
(74) *Attorney, Agent, or Firm* — Birch, Stewart, Kolasch & Birch, LLP

(57) ABSTRACT

In a screw rotor (40), a first suction-side area (45) is formed in a first side wall surface (42) of a spiral groove (41). In the first side wall surface (42), a portion extending from a start point to a point until immediately before a compression chamber (23) is in a completely-closed state defines the first suction-side area (45). The first suction-side area (45) is thinner than a portion of the first side wall surface (42) other than the first suction-side area (45), and does not contact a gate (51) of a gate rotor (50).

6 Claims, 11 Drawing Sheets

U.S. PATENT DOCUMENTS

| | | | | | |
|---|---|---|---|---|---|
| 3,945,778 | A | * | 3/1976 | Zimmern | 418/195 |
| 4,028,016 | A | * | 6/1977 | Keijer | 417/440 |
| 4,179,250 | A | * | 12/1979 | Patel | 418/195 |
| 4,261,691 | A | * | 4/1981 | Zimmern et al. | 417/440 |
| 4,342,548 | A | * | 8/1982 | Zimmern | 418/195 |
| 4,364,714 | A | * | 12/1982 | Zimmern | 417/53 |
| 4,470,777 | A | * | 9/1984 | Zimmern | 418/46 |
| 4,488,858 | A | * | 12/1984 | Glanvall | 418/195 |
| 4,704,069 | A | * | 11/1987 | Kocher et al. | 417/53 |
| 4,773,837 | A | * | 9/1988 | Shimomura et al. | 418/180 |
| 4,775,304 | A | * | 10/1988 | Bein | 418/99 |
| 4,824,348 | A | * | 4/1989 | Winyard | 418/195 |
| 4,880,367 | A | * | 11/1989 | Bein | 418/107 |
| 4,890,989 | A | * | 1/1990 | Zimmern | 418/153 |
| 4,981,424 | A | * | 1/1991 | Bein | 418/99 |
| 5,082,431 | A | * | 1/1992 | Bein | 418/97 |
| 5,087,182 | A | | 2/1992 | Zimmern et al. | |
| 5,642,992 | A | * | 7/1997 | Shaw | 418/152 |
| 5,782,624 | A | * | 7/1998 | Jensen | 418/195 |
| 5,807,091 | A | * | 9/1998 | Shaw | 418/152 |
| 6,093,007 | A | * | 7/2000 | Shaw | 418/197 |
| 6,205,779 | B1 | * | 3/2001 | Botosan et al. | 60/330 |
| 6,217,304 | B1 | * | 4/2001 | Shaw | 418/100 |
| 6,398,532 | B1 | * | 6/2002 | Zha et al. | 418/195 |
| 6,896,501 | B2 | * | 5/2005 | Ueno et al. | 418/195 |
| 7,153,112 | B2 | * | 12/2006 | Zarnoch et al. | 418/195 |
| 7,891,955 | B2 | * | 2/2011 | Picouet | 417/213 |
| 2004/0037730 | A1 | * | 2/2004 | Ueno et al. | 418/195 |
| 2005/0123429 | A1 | * | 6/2005 | Zarnoch et al. | 418/195 |
| 2005/0152803 | A1 | * | 7/2005 | Manfredini et al. | 418/196 |
| 2006/0210419 | A1 | * | 9/2006 | Chadwick, II | 418/196 |
| 2007/0172375 | A1 | * | 7/2007 | Lurtz | 418/196 |

FOREIGN PATENT DOCUMENTS

| | | | |
|---|---|---|---|
| JP | 3-164591 | A | 7/1991 |
| JP | 11-336681 | A | 12/1999 |
| JP | 2002-202080 | A | 7/2002 |

* cited by examiner

SINGLE SCREW COMPRESSOR AND A METHOD FOR PROCESSING A SCREW ROTOR

TECHNICAL FIELD

The present invention relates to improvement of efficiency of a single screw compressor.

BACKGROUND ART

Conventionally, single screw compressors have been used as compressors for compressing refrigerant or air. For example, Patent Document 1 discloses a single screw compressor including a single screw rotor and two gate rotors.

Such a single screw compressor will be described with reference to FIG. 13. As illustrated in FIG. 13, a screw rotor (200) is formed in an approximately cylindrical shape, and a plurality of spiral grooves (201) are formed in an outer circumference thereof. Gate rotors (210) are formed in an approximately flat plate-like shape, and are arranged on sides of the screw rotor (200). A plurality of rectangular plate-like gates (211) are radially provided in the gate rotor (210). The gate rotor (210) is installed with its rotation axis being perpendicular to a rotation axis of the screw rotor (200), and the gate (211) is to be engaged with the spiral groove (201) of the screw rotor (200).

Although not illustrated in FIG. 13, in the single screw compressor, the screw rotor (200) and the gate rotors (210) are accommodated in a casing, and the spiral groove (201) of the screw rotor (200), the gate (211) of the gate rotor (210), and an inner wall surface of the casing define a compression chamber (220). When rotatably driving the screw rotor (200) by an electric motor, etc., the gate rotors (210) rotate in response to the rotation of the screw rotor (200). Subsequently, the gate (211) of the gate rotor (210) relatively moves from a start point (a left end as viewed in FIG. 13) toward a terminal point (a right end as viewed in FIG. 13) in the spiral groove (201) with which the gate is engaged, thereby gradually reducing the volume of the completely-closed compression chamber (220). Consequently, fluid in the compression chamber (220) is compressed.

CITATION LIST

Patent Document

PATENT DOCUMENT 1: Japanese Patent Publication No. 2002-202080

SUMMARY OF THE INVENTION

Technical Problem

In the single screw compressor, for a time period from an end of a suction stroke to a beginning of a compression stroke in a certain compression chamber (220), the gate (211) defining the compression chamber (220) enters a start-point portion of the spiral groove (201). In the course of the entrance of the gate (211) into the spiral groove (201), the gate (211) slidably contacts a side wall surface (202) of the spiral groove (201), which is positioned on a front side in a traveling direction of the gate (211), and slidably contacts a bottom wall surface (204) of the spiral groove (201), followed by slidably contacting a side wall surface (203) of the spiral groove (201), which is positioned on a rear side in the traveling direction of the gate (211). After all of the both side wall surfaces (202, 203) and bottom wall surface (204) of the spiral groove (201) contact the gate (211), the compression chamber (220) is in a completely-closed state in which the compression chamber (220) is blocked off from a low-pressure space filled with pre-compressed low-pressure gas.

As described above, for the time period from the end of the suction stroke to the beginning of the compression stroke, the compression chamber (220) communicates with the low-pressure space until immediately before the side wall surface (203) of the spiral groove (201), which is positioned on the rear side in the traveling direction of the gate (211) slidably contacts the gate (211). Thus, it is not necessary to seal a space between the gate (211) and the screw rotor (200) until immediately before the compression chamber (220) is in the completely-closed state. If the gate (211) slidably contacts the screw rotor (200) during such a period, power is consumed due to sliding resistance therebetween, thereby possibly causing reduction in efficiency of the screw compressor.

The present invention has been made in view of the foregoing, and it is an object of the present invention to shorten the time period for which the screw rotor slidably contacts the gate rotors, and to reduce the power consumed due to the sliding resistance therebetween, thereby improving the efficiency of the single screw compressor.

Solution to the Problem

A first aspect of the invention is intended for a single screw compressor including a screw rotor (40) formed with a plurality of spiral grooves (41) in an outer circumference, a casing (10) in which the screw rotor (40) is accommodated, and gate rotors (50) with a plurality of radially-formed gates (51) to be engaged with the spiral grooves (41) of the screw rotor (40); and the single screw compressor compresses fluid in a compression chamber (23) defined by the screw rotor (40), the casing (10), and the gate (51), by relatively moving the gate (51) from a start point to a terminal point in the spiral groove (41). In addition, a first side wall surface (42) of a pair of side wall surfaces of the spiral groove (41) of the screw rotor (40), which is positioned on a front side in a traveling direction of the gate (51) is formed with a first suction-side area (45) where a portion of the first side wall surface (42), which extends from the start point to a point immediately before the compression chamber (23) is completely closed, is partially removed so as not to entirely contact a side surface of the gate (51).

In the first aspect of the invention, the gate (51) of the gate rotor (50) is to be engaged with the spiral groove (41) of the screw rotor (40). When rotating the screw rotor (40) and the gate rotors (50), the gate (51) relatively moves from the start point to the terminal point in the spiral groove (41), thereby compressing the fluid in the compression chamber (23). In the course of the entrance of the gate (51) into the start-point side of the spiral groove (41), after the gate (51) slidably contacts both side wall surfaces (42, 43) and bottom wall surface (44) of the spiral groove (41), the compression chamber (23) is completely closed.

In the screw rotor (40) of the first aspect of the invention, the first suction-side area (45) is formed in the first side wall surface (42) of the both side wall surfaces (42, 43) of the spiral groove (41), which is positioned on the front side in the relative traveling direction of the gate (51). Until immediately before the compression chamber (23) is in the completely-closed state, the side surface of the gate (51) faces the first suction-side area (45) of the screw rotor (40), and the side surface of the gate (51) does not contact the first side wall surface (42) of the screw rotor (40). Thus, sliding resistance between the gate (51) and the first side wall surface (42) of the screw rotor (40) is substantially zero until immediately before the compression chamber (23) is in the completely-closed state.

A second aspect of the invention is intended for the single screw compressor of the first aspect of the invention, in which the depth of the first suction-side area (45) gradually becomes deeper toward the start point of the spiral groove (41).

In the second aspect of the invention, a clearance between the first suction-side area (45) of the first side wall surface (42) and the gate (51) is wider closer to the start point of the spiral groove (41). Consequently, in the course of the entrance of the gate (51) into the start-point side of the spiral groove (41), the gate (51) smoothly enters the spiral groove (41) without being stuck at the start point of the first side wall surface (42).

A third aspect of the invention is intended for the single screw compressor of the second aspect of the invention, in which a second side wall surface (43) of a pair of the side wall surfaces of the spiral groove (41) of the screw rotor (40), which is positioned on a rear side in the traveling direction of the gate (51), is formed with a second suction-side area (47) where a start-point portion of the second side wall surface (43) is partially removed; and the depth of the second suction-side area (47) gradually becomes deeper toward the start point of the spiral groove (41).

In the third aspect of the invention, the second suction-side area (47) is formed in the second side wall surface (43) of the both side wall surfaces (42, 43) of the spiral groove (41), which is positioned on the rear side in the relative traveling direction of the gate (51). A clearance between the second suction-side area (47) of the second side wall surface (43) and the gate (51) is wider closer to the start point of the spiral groove (41). Consequently, in the course of the entrance of the gate (51) into the start-point side of the spiral groove (41), the gate (51) smoothly enters the spiral groove (41) without being stuck at the start point of the second side wall surface (43).

A fourth aspect of the invention is intended for the single screw compressor of the third aspect of the invention, in which the depth of the first suction-side area (45) at the start point of the spiral groove (41) is deeper than that of the second suction-side area (47) at the start point of the spiral groove (41).

In the fourth aspect of the invention, at the start point of the spiral groove (41), where the depths of the first suction-side area (45) and second suction-side area (47) are maximum, the first suction-side area (45) is deeper than the second suction-side area (47).

A fifth aspect of the invention is intended for the single screw compressor of any one of the first to fourth aspects of the invention, in which a bottom wall surface (44) of the spiral groove (41) of the screw rotor (40) is formed with a third suction-side area (46) where a portion of the bottom wall surface (44), which extends from the start point to the point immediately before the compression chamber (23) is completely closed, is partially removed so as not to entirely contact a tip end surface of the gate (51).

In the fifth aspect of the invention, the third suction-side area (46) is formed not only in the first side wall surface (42) of the both side wall surfaces (42, 43) of the spiral groove (41), which is positioned on the front side in the relative traveling direction of the gate (51), but also in the bottom wall surface (44) of the spiral groove (41). Until immediately before the compression chamber (23) is in the completely-closed state, the tip end surface of the gate (51) faces the third suction-side area (46) of the screw rotor (40), and the tip end surface of the gate (51) does not contact the bottom wall surface (44) of the screw rotor (40). Thus, sliding resistance between the gate (51) and the bottom wall surface (44) of the screw rotor (40) is substantially zero until immediately before the compression chamber (23) is in the completely-closed state.

A sixth aspect of the invention is intended for a method for processing the screw rotor of the single screw compressor of the first aspect of the invention. When cutting a work (120) to be the screw rotor by a 5-axis machining center (100), a traveling path of a cutting tool (110) in a finish processing which uses the 5-axis machining center (100) is set so that the suction-side area (45, 46) is formed in the first side wall surface (42) or bottom wall surface (44) of the spiral groove (41).

In the sixth aspect of the invention, the screw rotor (40) is processed by using the 5-axis machining center (100). In the finish processing of the screw rotor (40), a surface of the work (120) to be the screw rotor (40) is cut by the cutting tool (110) such as end mills. At this point, the traveling path of the cutting tool (110) in the 5-axis machining center (100) is set so that the first suction-side area (45) is formed in the first side wall surface (42) of the spiral groove (41) of the screw rotor (40). That is, in the processing method of the present invention, the finish processing of the screw rotor (40) and the formation of the first suction-side area (45) are simultaneously performed.

Advantages of the Invention

In the first aspect of the invention, the first suction-side area (45) is formed in the first side wall surface (42) of the spiral groove (41) of the screw rotor (40). Until immediately before the compression chamber (23) is in the completely-closed state, the side surface of the gate (51), which is positioned on the front side in the relative traveling direction of the gate (51), does not contact the first side wall surface (42) of the spiral groove (41). That is, in the course of the entrance of the gate (51) into the spiral groove (41) of the screw rotor (40), the gate (51) does not contact the first side wall surface (42) of the spiral groove (41) for a time period for which the space between the gate (51) and the screw rotor (40) is not necessarily sealed. This reduces power consumed due to a slide of the gate (51) in the screw rotor (40) during such period of time, thereby improving the efficiency of the single screw compressor (1).

In the second aspect of the invention, the clearance between the first suction-side area (45) of the first side wall surface (42) and the gate (51) is wider closer to the start point of the spiral groove (41). In addition, in the third aspect of the invention, the clearance between the second suction-side area (47) of the second side wall surface (43) and the gate (51) is wider closer to the start point of the spiral groove (41). Consequently, according to these aspects of the invention, even if a relative position between the spiral groove (41) and the gate (51) does not exactly match a design value, the gate (51) can smoothly enter the spiral groove (41), thereby preventing the gate (51) from being damaged or worn out.

In the fifth aspect of the invention, until immediately before the compression chamber (23) is in the completely-closed state, not only the side surface of the gate (51) does not contact the first side wall surface (42) of the spiral groove (41), but also the tip end surface of the gate (51) does not contact the bottom wall surface (44) of the spiral groove (41). This further reduces the power consumed due to the slide of the gate (51) in the screw rotor (40) for such period of time, thereby further improving the efficiency of the single screw compressor (1).

In the sixth aspect of the invention, the first suction-side area (45) is formed during the finish processing of the screw rotor (40), which uses the 5-axis machining center (100). Thus, once the work (120) to be the screw rotor (40) is attached to the 5-axis machining center (100), the processing of the spiral groove (41) can be completed without detaching the work (120) from the 5-axis machining center (100). Consequently, according to the present invention, a time period required for the processing of the screw rotor (40) can be shortened. In addition, according to the present invention, by using the 5-axis machining center (100), a part of an area of the first side wall surface (42) of the spiral groove (41), which extends from the start point to the point immediately before the compression chamber (23) is in the completely-closed state, can be easily removed across the entire surface.

BRIEF DESCRIPTION OF THE DRAWINGS

FIG. 6 are plan views illustrating operations of a compression mechanism of the embodiment.

DESCRIPTION OF REFERENCE CHARACTERS

1 Single Screw Compressor
10 Casing
23 Compression Chamber
40 Screw Rotor
41 Spiral Groove
42 First Side Wall Surface
43 Second Side Wall Surface
44 Bottom Wall Surface
45 First Suction-Side Area
46 Third Suction-Side Area
47 Second Suction-Side Area
50 Gate Rotor
51 Gate
100 5-Axis Machining Center (5-axis Processor)
110 Cutting Tool

DESCRIPTION OF EMBODIMENT

An Embodiment of the present invention will be described hereinafter in detail with reference to the drawings.

A single screw compressor (1) of the present embodiment (hereinafter simply referred to as a "screw compressor") compresses refrigerant, which is provided in a refrigerant circuit in which a refrigeration cycle is performed.

Figure 1:
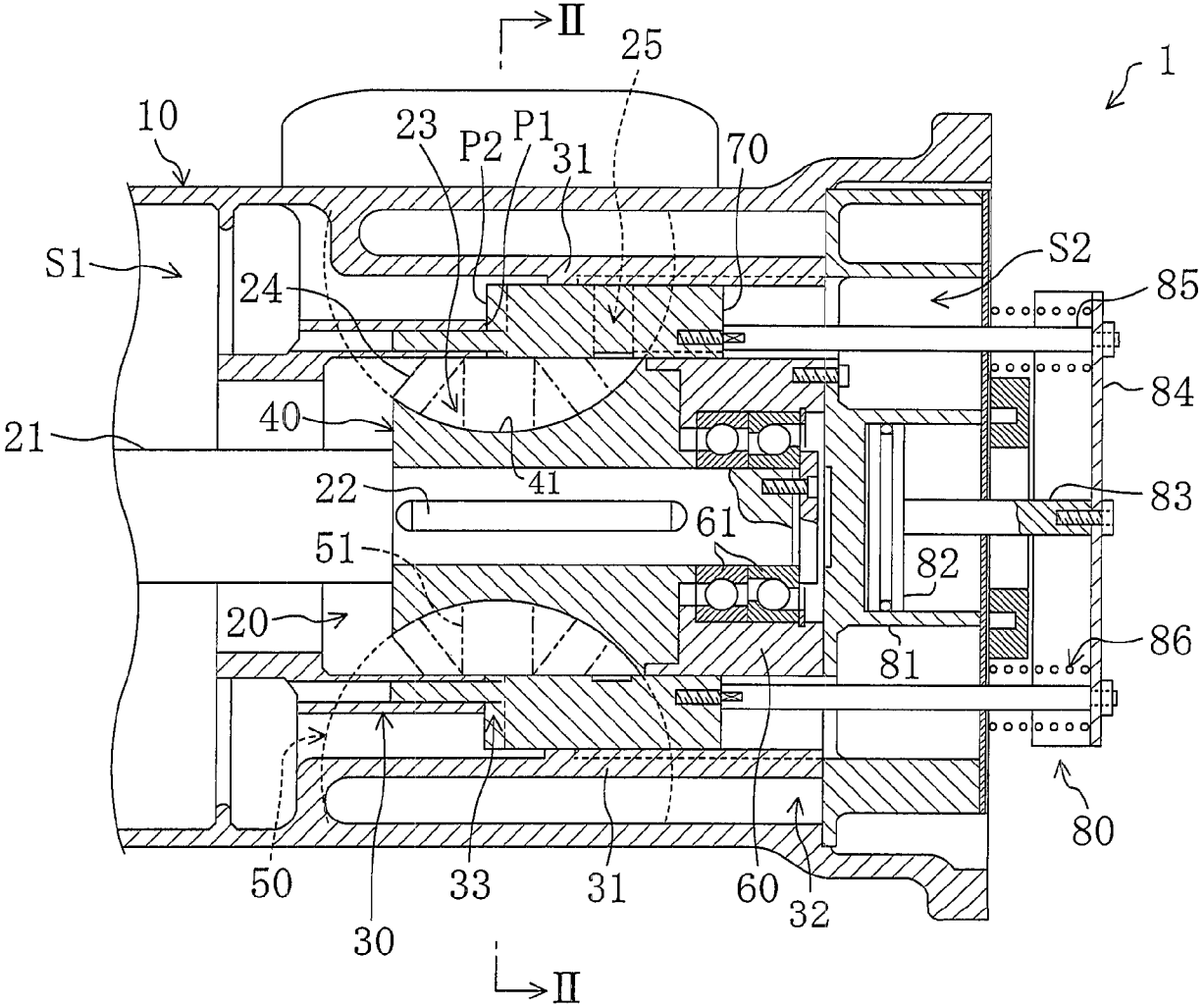
FIG. 1 is a longitudinal sectional view illustrating a structure including a main part of a single screw compressor of an embodiment.
Figure 2:
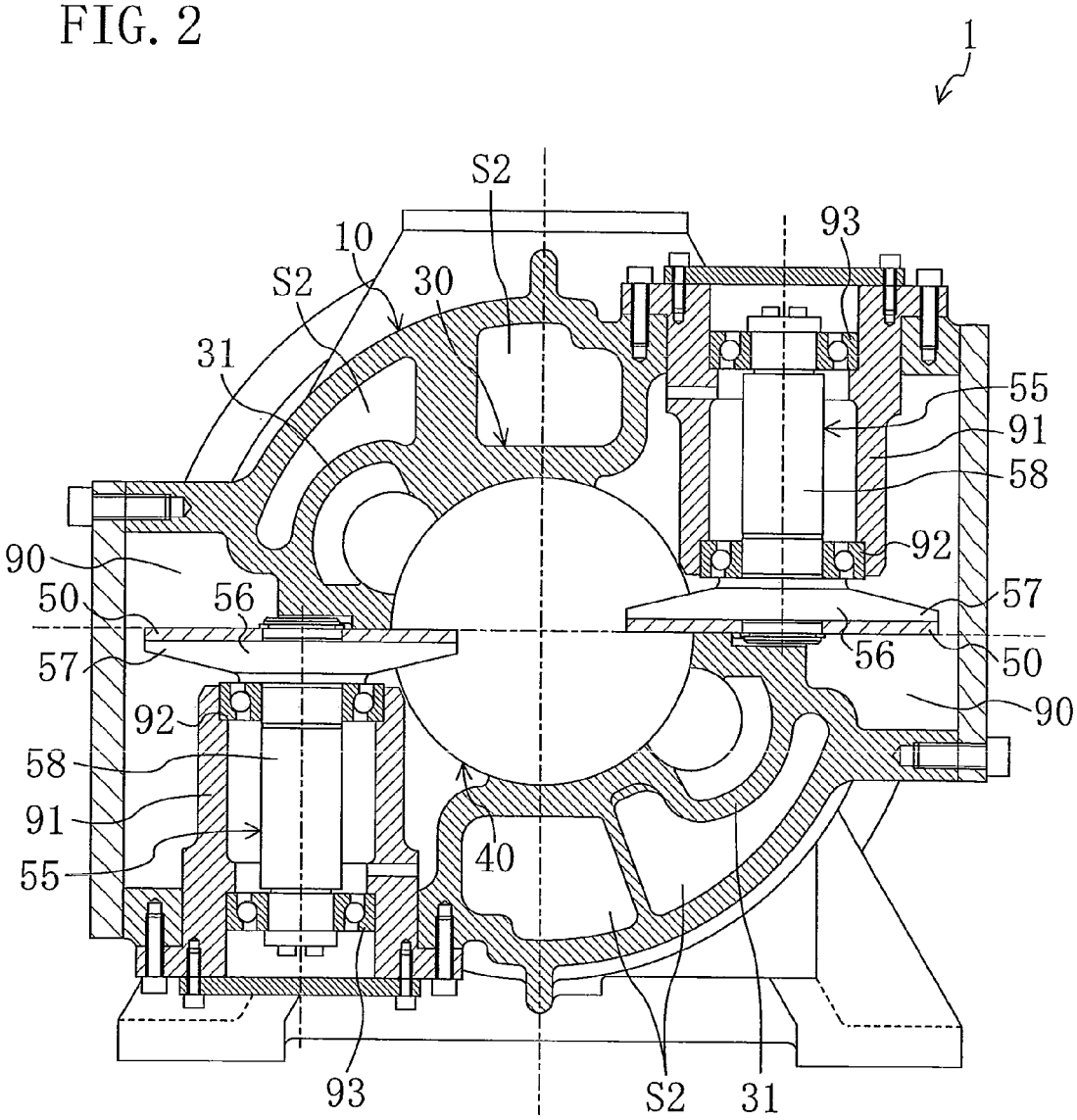
FIG. 2 is an II-II cross-sectional view of FIG. 1.

As illustrated in FIGS. 1 and 2, the screw compressor (1) is semi-hermetic. In the screw compressor (1), a compression mechanism (20) and an electric motor driving the compression mechanism (20) are accommodated in a single casing (10). The compression mechanism (20) is connected to the electric motor by a drive shaft (21). In FIG. 1, the electric motor is omitted. In addition, the casing (10) is formed so as to be divided into a low-pressure space (S1) to which low-pressure gas refrigerant is introduced from an evaporator of the refrigerant circuit, and which guides the low-pressure gas to the compression mechanism (20); and a high-pressure space (S2) into which high-pressure gas refrigerant discharged from the compression mechanism (20) flows.

The compression mechanism (20) includes a cylindrical wall (30) formed in the casing (10); a single screw rotor (40) arranged in the cylindrical wall (30); and two gate rotors (50) to be engaged with the screw rotor (40). The drive shaft (21) is inserted through the screw rotor (40). The screw rotor (40) and the drive shaft (21) are connected to each other by a key (22). The drive shaft (21) and the screw rotor (40) are coaxially arranged. A tip end portion of the drive shaft (21) is rotatably supported by a bearing holder (60) positioned on a high-pressure side of the compression mechanism (20) (on a right side in an axial direction of the drive shaft (21) as viewed in FIG. 1). The bearing holder (60) supports the drive shaft (21) by ball bearings (61).

Figure 3:
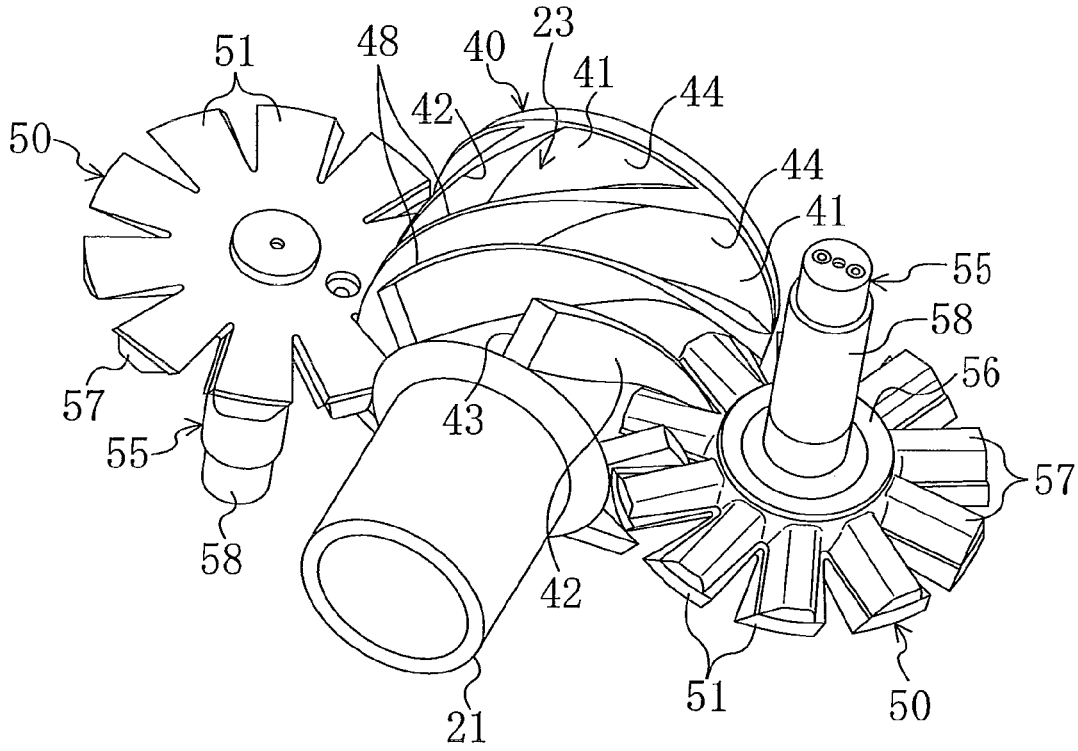
FIG. 3 is a perspective view focusing on the main part of the single screw compressor of the embodiment.
Figure 4:
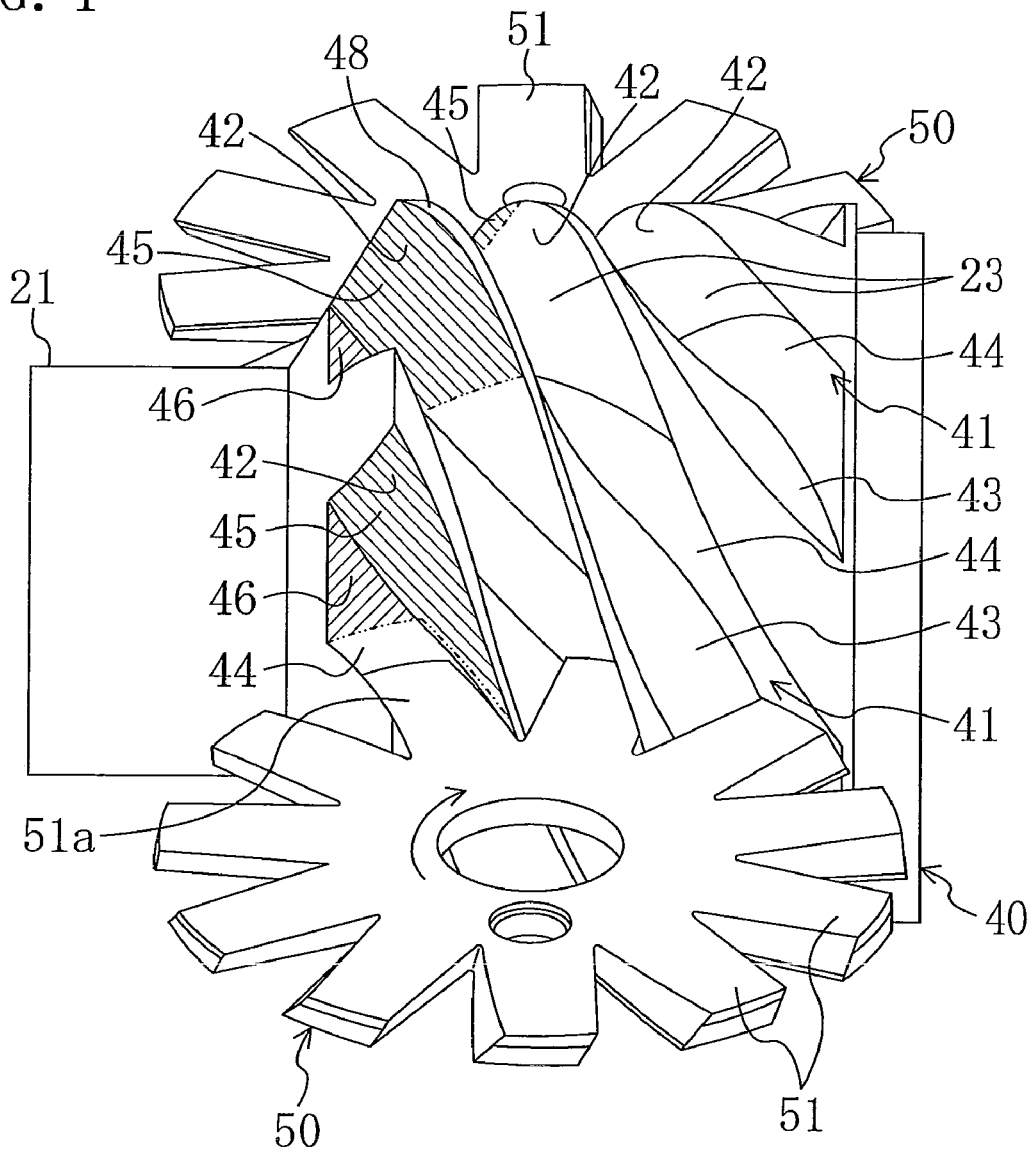
FIG. 4 is another perspective view focusing on the main part of the single screw compressor of the embodiment.

As illustrated in FIGS. 3 and 4, the screw rotor (40) is a metal member formed in an approximately cylindrical shape. The screw rotor (40) is rotatably fitted to the cylindrical wall (30), and an outer circumferential surface thereof slidably contacts an inner circumferential surface of the cylindrical wall (30). A plurality of spiral grooves (41) (in the present embodiment, 6 spiral grooves) spirally extending from one end of the screw rotor (40) to the other end are formed in the outer circumference of the screw rotor (40). In the screw rotor (40), a wall portion (48) is provided between the adjacent spiral grooves (41), and surfaces of the wall portion (48) define side wall surfaces (42, 43) of the spiral groove (41).

As viewed in FIG. 4, a left end of each spiral groove (41) of the screw rotor (40) is a start point, and a right end is a terminal point. In addition, a left end portion of the screw rotor (40) as viewed in FIG. 4 (end portion on a suction side) is formed so as to be tapered. In the screw rotor (40) illustrated in FIG. 4, the start point of the spiral groove (41) opens at the left end surface which is formed so as to be tapered, and the terminal point of the spiral groove (41) does not open at the right end surface.

One of the both side wall surfaces (42, 43) of the spiral groove (41), which is positioned on a front side in a traveling direction of gates (51) is the first side wall surface (42), and the other which is positioned on a rear side in the traveling direction of the gates (51) is the second side wall surface (43). In the screw rotor (40), a part of the first side wall surface (42) and bottom wall surface (44) of the spiral groove (41) is suction-side areas (45, 46). These will be described later.

Each gate rotor (50) is a resin member in which a plurality of gates (51) (in the present embodiment, 11 gates) formed in a rectangular plate-like shape are radially provided. The gate rotors (50) are arranged on an outer side of the cylindrical wall (30) so as to be axisymmetrical about a rotation axis of the screw rotor (40). A central axis of each gate rotor (50) is perpendicular to a central axis of the screw rotor (40). Each gate rotor (50) is arranged such that the gates (51) are engaged with the spiral grooves (41) of the screw rotor (40) with the gates (51) penetrating through a part of the cylindrical wall (30).

The gate rotor (50) is attached to a rotor support (55) made of metal (see FIG. 3). The rotor support (55) includes a base (56), aims (57), and a shaft (58). The base (56) is formed in a slightly-thick disc-like shape. There are the same number of arms (57) as that of gates (51) of the gate rotor (50), and the arms (57) radially and outwardly extend from an outer circumferential surface of the base (56). The shaft (58) is formed in a rod-like shape, and is vertically arranged on the base (56). A central axis of the shaft (58) matches a central axis of the base (56). The gate rotor (50) is attached to a surface on a side opposite to the shaft (58) with respect to the base (56) and the arms (57). Each arm (57) contacts a back surface of the gate (51).

The rotor supports (55) to which the gate rotors (50) are attached are accommodated in gate rotor chambers (90) defined and formed near the cylindrical wall (30) in the casing (10) (see FIG. 2). The rotor support (55) arranged on the right side of the screw rotor (40) as viewed in FIG. 2 is installed with the gate rotor (50) being arranged on a lower end side. On the other hand, the rotor support (55) arranged on the left side of the screw rotor (40) as viewed in FIG. 2 is installed with the gate rotor (50) being arranged on an upper end side. The shaft (58) of each rotor support (55) is rotatably supported by the ball bearings (92, 93) in a bearing housing (91) of the gate rotor chamber (90). Each gate rotor chamber (90) communicates with the low-pressure space (S1).

In the compression mechanism (20), a space surrounded by the inner circumferential surface of the cylindrical wall (30), the spiral groove (41) of the screw rotor (40), and the gate (51) of the gate rotor (50) defines a compression chamber (23). A suction-side end portion of the spiral groove (41) of the screw rotor (40) opens to the low-pressure space (S1), and such an opening portion functions as a suction port (24) of the compression mechanism (20).

The screw compressor (1) is provided with slide valves (70) as a capacity control mechanism. The slide valves (70) are provided in slide valve accommodating portions (31) where two portions of the cylindrical wall (30) in the circumferential direction thereof outwardly protrude in a radial direction. An inner surface of the slide valve (70) defines a part of the inner circumferential surface of the cylindrical wall (30), and the slide valve (70) is configured so as to slide in an axial direction of the cylindrical wall (30).

When sliding the slide valve (70) toward the high-pressure space (S2) (toward the right side in the axial direction of the drive shaft (21) as viewed in FIG. 1), a space is axially formed between an end surface (P1) of the slide valve accommodating portion (31) and an end surface (P2) of the slide valve (70). Such an axially-formed space functions as a bypass path (33) for returning refrigerant from the compression chamber (23) to the low-pressure space (S1). When changing the degree of opening of the bypass path (33) by moving the slide valve (70), the capacity of the compression mechanism (20) is changed. The slide valve (70) is formed with a discharge port (25) for making the compression chamber (23) communicate with the high-pressure space (S2).

A slide valve drive mechanism (80) for slidably driving the slide valve (70) is provided in the screw compressor (1). The slide valve drive mechanism (80) includes a cylinder (81) fixed to the bearing holder (60); a piston (82) loaded in the cylinder (81); an arm (84) connected to a piston rod (83) of the piston (82); connecting rods (85) for connecting the arm (84) to the slide valves (70); and springs (86) for biasing the arm (84) to the right as viewed in FIG. 1 (in a direction of separating the arm (84) from the casing (10)).

In the slide valve drive mechanism (80) illustrated in FIG. 1, an internal pressure in a space on the left side of the piston (82) (space on the screw rotor (40) side with respect to the piston (82)) is higher than that in a space on the right side of the piston (82) (space on the arm (84) side with respect to the piston (82)). The slide valve drive mechanism (80) is configured to adjust a position of the slide valve (70) by adjusting the internal pressure in the space on the right side of the piston (82) (i.e., gas pressure in the right-side space).

During the operation of the screw compressor (1), suction pressure of the compression mechanism (20) acts on one axial end surface of the slide valve (70), and discharge pressure of the compression mechanism (20) acts on the other. This makes a force in a direction of pushing the slide valve (70) toward the low-pressure space (S1) side constantly act on the slide valve (70) during the operation of the screw compressor (1). Consequently, when changing the internal pressure in the spaces on the left and right side of the piston (82) in the slide valve drive mechanism (80), the magnitude of a force in a direction of pulling the slide valve (70) toward the high-pressure space (S2) side is changed, thereby changing the position of the slide valve (70).

The suction-side areas (45, 46) formed in the screw rotor (40) will be described with reference to FIGS. 4 and 5.

When driving and rotating the screw rotor (40) by the electric motor, the gate rotors (50) rotates in response to the rotation of the screw rotor (40). As viewed in FIG. 4, the gate rotor (50) on the front side rotates clockwise, whereas the gate rotor (50) on the rear side rotates counterclockwise. In FIG. 4, the compression chambers (23) in the spiral grooves (41) engaged with the gate rotor (50) positioned on the front side are divided into upper and lower portions by the gates (51). The upper portion with respect to the gate (51) communicates with the low-pressure space (S1), whereas the lower portion with respect to the gate (51) is a closed space or communicates with the high-pressure space (S2).

As viewed in FIG. 4, a gate (51*a*) provided in the gate rotor (50) on the front side is at a position where the gate (51*a*) slightly advances from a point immediately after the compression chamber (23) is in the completely-closed state (i.e., the closed space where the compression chamber (23) does not communicate with either the low-pressure space (S1) or the high-pressure space (S2)) in the spiral groove (41) engaged with the gate (51*a*). In the spiral groove (41) engaged with the gate (51*a*), portions of the first side wall surface (42) and bottom wall surface (44), which are positioned above the gate (51*a*), define the suction-side areas (45, 46).

Figure 5:
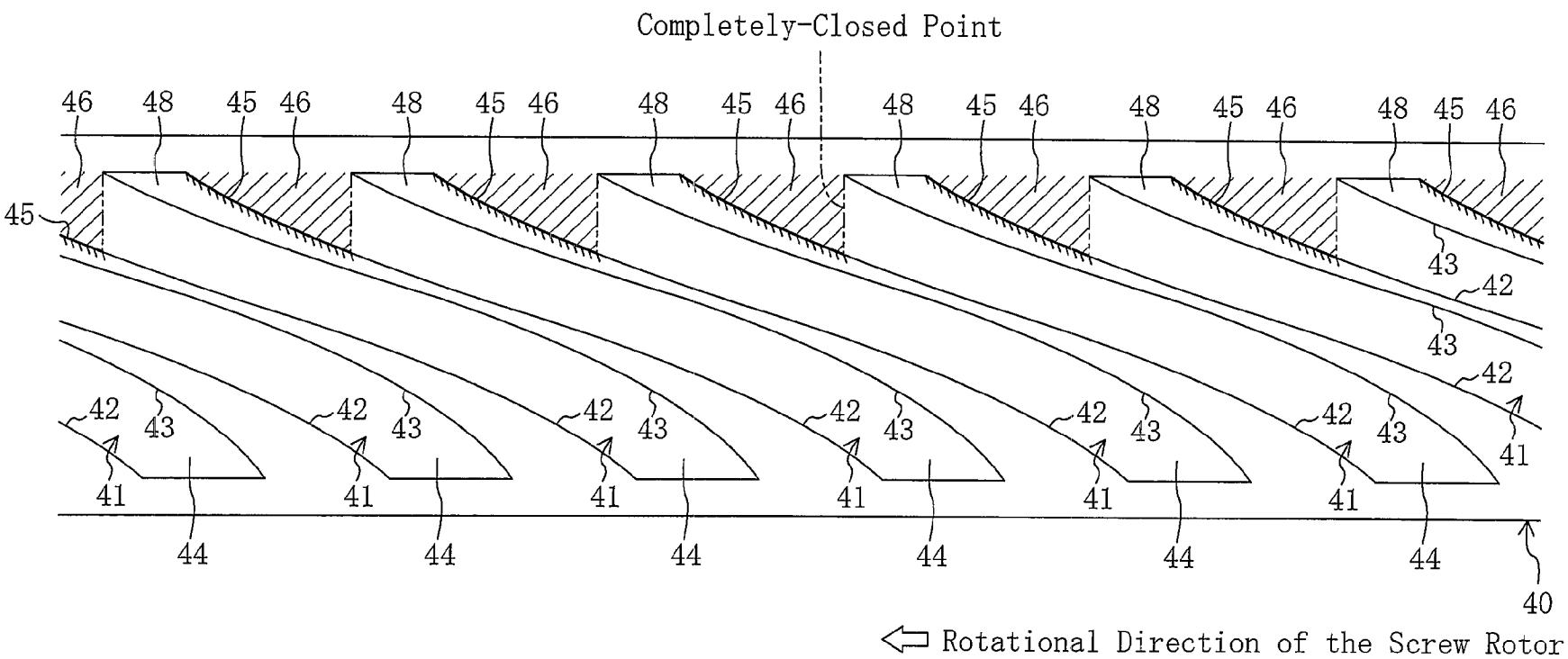
FIG. 5 is a development view of the screw rotor illustrated in FIG. 4.

In the course of the entrance of the gate (51) into the start point of the spiral groove (41), immediately after the gate (51) reaches a completely-closed point illustrated in FIG. 5, the compression chamber (23) is in the completely-closed state in which the compression chamber (23) is blocked off from the low-pressure space (S1) by the gate (51). In each spiral groove (41) formed in the screw rotor (40), portions of the first side wall surface (42) and bottom wall surface (44) of the spiral groove (41), which extend from the start point to the point until immediately before the compression chamber (23) is in the completely-closed state, i.e., shaded portions of the first side wall surface (42) and bottom wall surface (44) illustrated in FIGS. 4 and 5, define the suction-side areas (45, 46).

That is, in the spiral grooves (41) other than the spiral groove (41) engaged with the gate (51*a*) illustrated in FIG. 4, the similar portions of the first side wall surface (42) and bottom wall surface (44) define the suction-side areas (45, 46). In addition, in each spiral groove (41), the suction-side area formed in the first side wall surface (42) is the first suction-side area (45), and the suction-side area formed in the bottom wall surface (44) is the third suction-side area (46).

The first suction-side area (45) is formed in the first side wall surface (42). In the first side wall surface (42), the first suction-side area (45) is partially removed so as to be thinner than a portion other than the first suction-side area (45) (i.e., portion extending from the point immediately after the compression chamber (23) is in the completely-closed state to the terminal point). Consequently, a clearance between the first suction-side area (45) and a side surface of the gate (51) is wider than that between the portion of the first side wall surface (42) other than the first suction-side area (45) and the side surface of the gate (51) by, e.g., approximately 0.1 mm.

The third suction-side area (46) is formed in the bottom wall surface (44). In the bottom wall surface (44), the third suction-side area (46) is partially removed so as to be thinner than a portion other than the third suction-side area (46) (i.e., portion extending from the point immediately after the compression chamber (23) is in the completely-closed state to the terminal point). Consequently, a clearance between the third suction-side area (46) and a tip end surface of the gate (51) is wider than that between the portion of the bottom wall surface (44) other than the third suction-side area (46) and the tip end surface of the gate (51) by, e.g., approximately 0.1 mm.

Operation

The operation of the single screw compressor (1) will be described.

When starting the electric motor in the single screw compressor (1), the screw rotor (40) rotates in response to rotation of the drive shaft (21). The gate rotors (50) also rotate in response to the rotation of the screw rotor (40), and the compression mechanism (20) repeats suction, compression, and discharge strokes. A compression chamber (23) which is shaded portion in FIG. 6 will be described hereinafter.

Figure 6A:
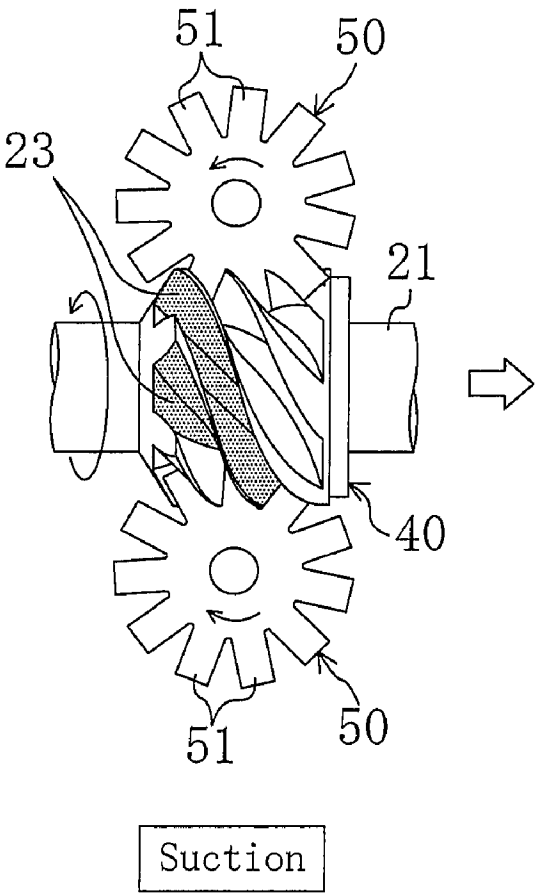
FIG. 6(A) illustrates a suction stroke.

In FIG. 6(A), the shaded compression chambers (23) communicate with the low-pressure space (S1). The spiral grooves (41) in which such compression chambers (23) are formed are engaged with the gates (51) of the gate rotor (50) positioned on a lower side as viewed in FIG. 6(A). When rotating the screw rotor (40), the gates (51) relatively move toward the terminal points of the spiral grooves (41), and then the volume of the compression chamber (23) increases in response thereto. Consequently, the low-pressure gas refrigerant in the low-pressure space (S1) is sucked into the compression chamber (23) through the suction port (24).

Figure 6B:
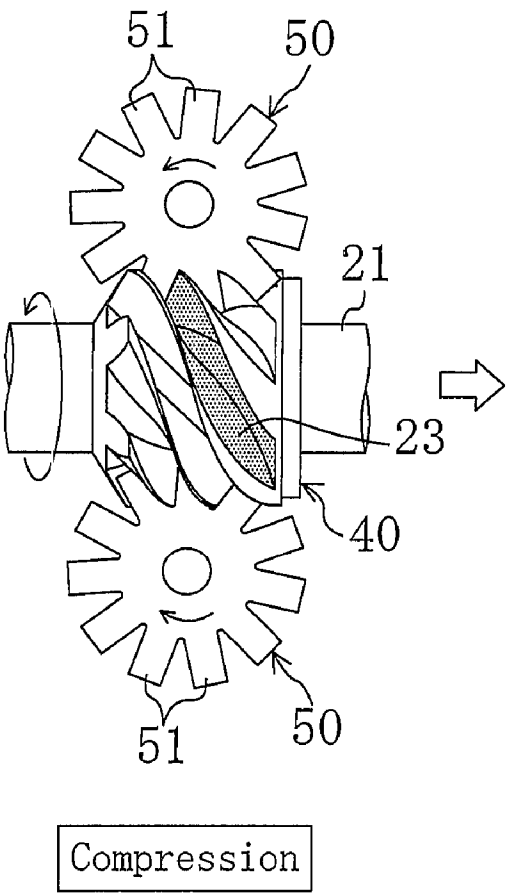
FIG. 6(B) illustrates a compression stroke.

A further rotation of the screw rotor (40) brings a state illustrated in FIG. 6(B). In FIG. 6(B), the shaded compression chamber (23) is in the completely-closed state. That is, the spiral groove (41) in which such a compression chamber (23) is formed is engaged with the gate (51) of the gate rotor (50) positioned on an upper side as viewed in FIG. 6(B), and is separated from the low-pressure space (S1) by the gate (51). When the gate (51) relatively moves toward the terminal point of the spiral groove (41) in response to the rotation of the screw rotor (40), the volume of the compression chamber (23) is gradually reduced. Consequently, the gas refrigerant in the compression chamber (23) is compressed.

Figure 6C:
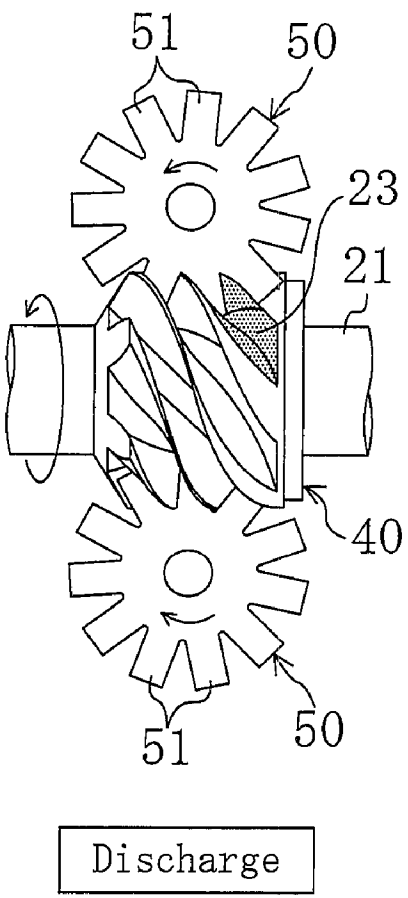
FIG. 6(C) illustrates a discharge stroke.

A further rotation of the screw rotor (40) brings a state illustrated in FIG. 6(C). In FIG. 6(C), the shaded compression chamber (23) communicates with the high-pressure space (S2) through the discharge port (25). When the gate (51) relatively moves toward the terminal point of the spiral groove (41) in response to the rotation of the screw rotor (40), the compressed gas refrigerant is pushed from the compression chamber (23) to the high-pressure space (S2).

Focusing on one of the plurality of compression chambers (23) formed in the compression mechanism (20), for a time period from an end of the suction stroke to a beginning of the compression stroke in the compression chamber (23), the gate (51) defining the compression chamber (23) enters the spiral groove (41) through the suction port (24) opening at the end surface of the screw rotor (40). In the course of the entrance of the gate (51) into the spiral groove (41), only the side surface of the gate (51), which is positioned on the front side in the traveling direction of the gate (51), and the tip end surface of the gate (51) face the wall surfaces (42, 44) of the spiral groove (41) first, and then the side surface of the gate (51), which is positioned on the rear side in the traveling direction of the gate (51), faces the wall surface (43) of the spiral groove (41).

In the screw rotor (40) of the present embodiment, the suction-side areas (45, 46) are formed in the first side wall surface (42) and the bottom wall surface (44). Thus, in the course of the entrance of the gate (51) into the spiral groove (41), while the gate (51) is facing only the first side wall surface (42) and the bottom wall surface (44), a non-contact state between the gate (51) and the screw rotor (40) is maintained. Since the spiral groove (41) communicates with the low-pressure space (S1) during such period of time, no problem will be caused even if a relatively-large space is present between the gate (51) and the screw rotor (40). When the gate (51) reaches the point at which the compression chamber (23) in the spiral groove (41) is completely closed, the gate (51) slidably contacts the both side wall surfaces (42, 43) and bottom wall surface (44) of the spiral groove (41).

After the gate (51) reaches to the point at which the compression chamber (23) in the spiral groove (41) is completely closed, it is not necessary that the gate (51) physically contacts the wall surfaces (42, 43, 44) of the spiral groove (41), and there may be no problem if a minute space is present therebetween. That is, even with the minute space between the gate (51) and the wall surface (42, 43, 44) of the spiral groove (41), if such a space can be sealed by an oil film made of lubricant oil, the hermeticity in the compression chamber (23) can be maintained, thereby reducing the amount of the gas refrigerant leaking from the compression chamber (23) to the minimum.

Method for Processing the Screw Rotor

The screw rotor (40) of the present embodiment is processed by using a 5-axis machining center (100) which is a 5-axis processor.

Figure 7:
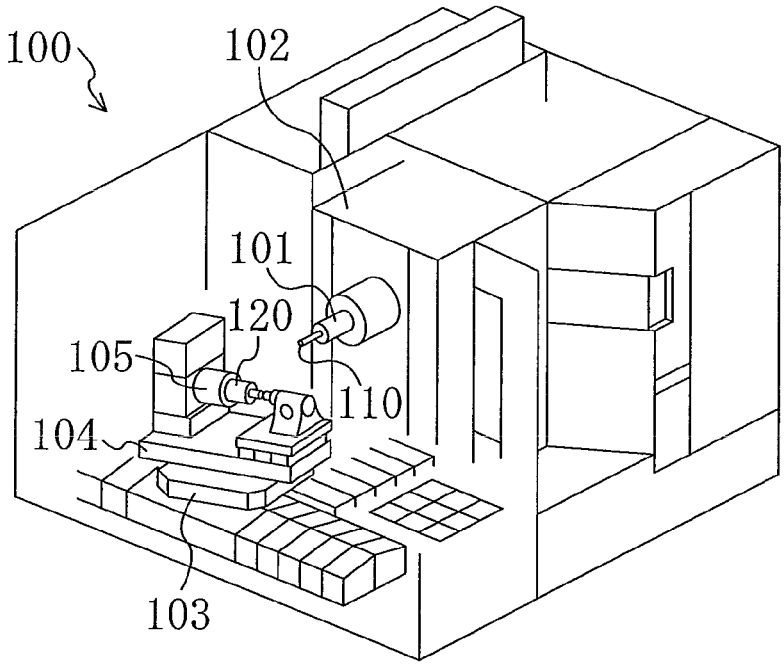
FIG. 7 is a perspective view schematically illustrating an entire structure of a 5-axis machining center used for processing the screw rotor.

As illustrated in FIG. 7, the 5-axis machining center (100) includes a main shaft (101) to which a cutting tool (110) such as end mills is attached; and a column (102) to which the main shaft (101) is attached. In addition, the 5-axis machining center (100) includes a rotatable table (104) rotatably attached to a base table (103); and a clamping portion (105) for clamping a work (120) being an object to be cut, which is installed on the rotatable table (104).

Figure 8:
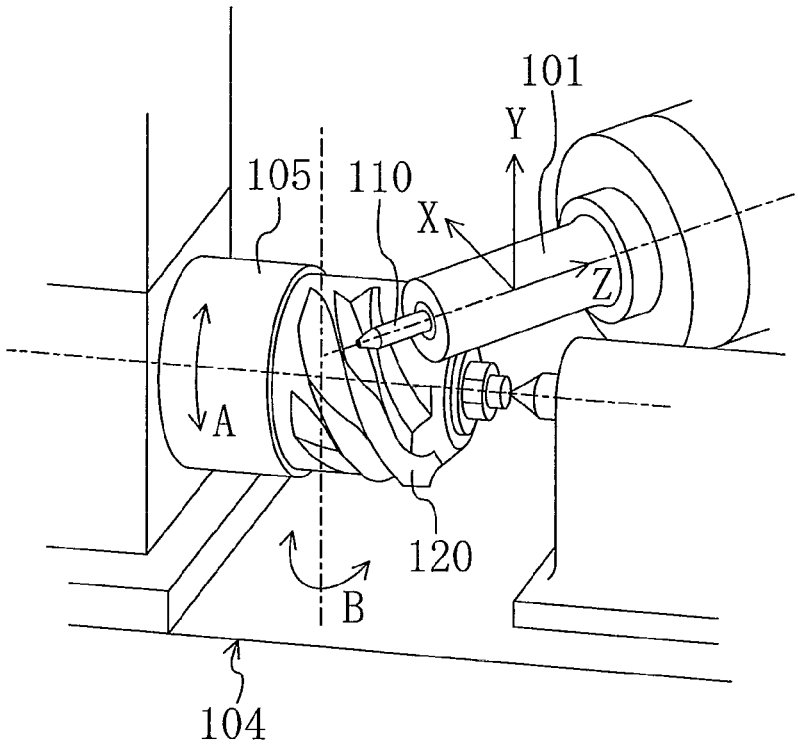
FIG. 8 is a perspective view schematically illustrating a main part of the 5-axis machining center used for processing the screw rotor.

As illustrated in FIG. 8, in the 5-axis machining center (100), three degrees of freedom are assigned to the tool side, and two degrees of freedom are assigned to the work (120) side. Specifically, the main shaft (101) is movable in an X-axis direction perpendicular to a rotation axis of the main shaft (101), a Y-axis direction perpendicular to the rotation axis and the X-axis direction, and a Z-axis direction which is the rotation axis direction. The clamping portion (105) is rotatable about its central axis (about an A axis). The rotatable table (104) to which the clamping portion (105) is attached is rotatable about an axis perpendicular to the axial direction of the clamping portion (105) (about a B axis). That is, in the 5-axis machining center (100), the cutting tool (110) is movable parallel to the X-axis, Y-axis, and Z-axis directions, whereas the work (120) is rotatable about the A and B axes.

In the 5-axis machining center (100), the cutting tool (110) is moved based on a tool path which is provided in advance as numerical data, thereby processing the work (120) to be the screw rotor (40). The 5-axis machining center (100) sequentially performs a plurality of processes from a rough cut to a finish by using a plurality types of cutting tools (110). The tool path in the finish processing is set so that the first suction-side area (45) and the third suction-side area (46) are formed in the work (120) to be the screw rotor (40). That is, in the finish processing, the tool path is set so that a cutting amount in a certain portion of the first side wall surface (42) or bottom wall surface (44) of the spiral groove (41) is larger than that in the other portion.

Advantages of the Embodiment

In the screw rotor (40) of the present embodiment, a portion of the first side wall surface (42) of the spiral groove (41) defines the first suction-side area (45), and a portion of the bottom wall surface (44) of the spiral groove (41) defines the third suction-side area (46). After the gate (51) starting to enter the spiral groove (41) and immediately before the compression chamber (23) being completely closed, the side surface of the gate (51) does not contact the first side wall surface (42) of the spiral groove (41), and the tip end surface of the gate (51) does not contact the bottom wall surface (44) of the spiral groove (41). That is, in the course of the entrance of the gate (51) into the spiral groove (41) of the screw rotor (40), the gate (51) does not contact the first side wall surface (42) and bottom wall surface (44) of the spiral groove (41) for the time period for which the space between the gate (51) and the screw rotor (40) is not necessarily sealed. This reduces the power consumed due to the slide of the gate (51) in the screw rotor (40) during such a non-contact state, thereby improving the efficiency of the single screw compressor (1).

In addition, the screw rotor (40) of the present embodiment is processed by using the 5-axis machining center (100). In the 5-axis machining center (100), a traveling path (tool path) of the cutting tool (110) in the finish processing is set so that both of the first suction-side area (45) and the third suction-side area (46) are formed in the work (120) to be the screw rotor (40). Thus, once the work (120) to be the screw rotor (40) is attached to the 5-axis machining center (100), the processing of the spiral groove (41) can be completed without detaching the work (120) from the 5-axis machining center (100).

Consequently, according to the processing method of the present embodiment, a time period required for the processing of the screw rotor (40) can be shortened. In addition, since the 5-axis machining center (100) is used in the processing method of the present embodiment, a part of the areas of the first side wall surface (42) and bottom wall surface (44) of the spiral groove (41), which extend from the start point to the point immediately before the compression chamber (23) is completely closed, can be easily removed across the entire surface.

Modified Example 1 of the Embodiment

In the screw compressor (1) of the above-described embodiment, only the first suction-side area (45) of the first and third suction-side areas (45, 46) may be formed in the screw rotor (40). In this case, in the screw rotor (40), the first suction-side area (45) is formed in the first side wall surface (42) of the spiral groove (41), whereas the third suction-side area (46) is not formed in the bottom wall surface (44) of the spiral groove (41).

Figure 9:
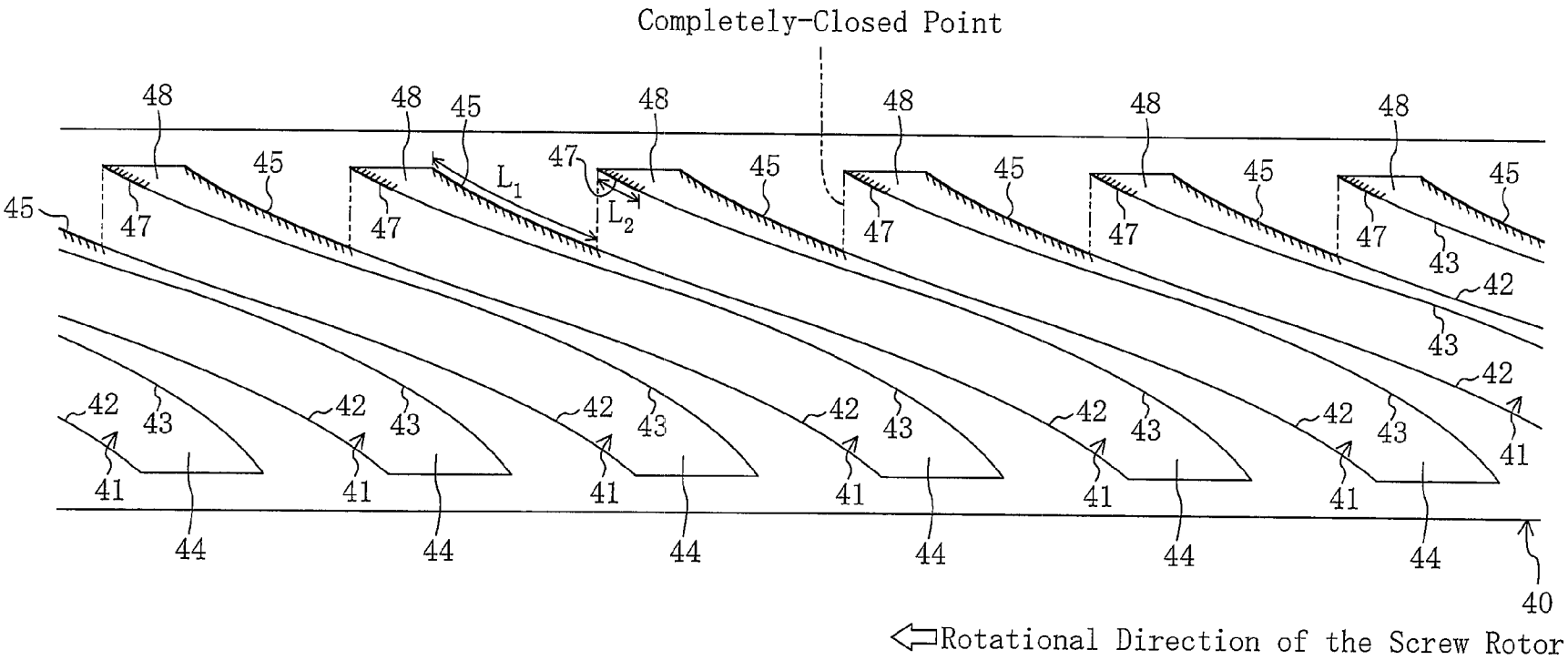
FIG. 9 is a development view of a screw rotor of Modified Example 1 of the embodiment.

As illustrated in FIG. 9, in the screw rotor (40) of the present modified example, a second suction-side area (47) may be formed in the second side wall surface (43) of the spiral groove (41). That is, in each spiral groove (41) of the screw rotor (40) illustrated in FIG. 9, the first suction-side area (45) and the second suction-side area (47) are formed in the first side wall surface (42) and the second side wall surface (43), respectively, and the third suction-side area (46) is not formed in the bottom wall surface (44). The second suction-side area (47) is formed by partially removing the start-point portion of the second side wall surface (43).

Figure 10:
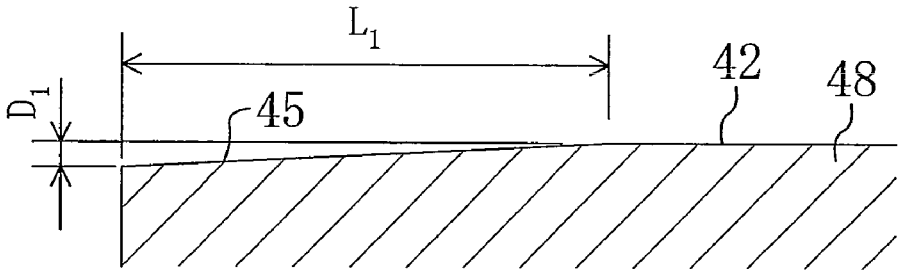
FIG. 10 is a cross-sectional view illustrating a main part of a wall portion of the screw rotor of Modified Example 1 of the embodiment.

In the screw rotor (40) illustrated in FIG. 9, the first suction-side area (45) is formed so that its depth gradually becomes deeper toward the start point of the spiral groove (41). A shape of the first suction-side area (45) will be described in detail with reference to FIG. 10. FIG. 10 illustrates a development view of a cross section of the wall portion (48) of the screw rotor (40) in the circumferential direction of the screw rotor (40). The first suction-side area (45) illustrated in FIG. 10 has an inclined surface where the surface is inclined at a certain rate toward the start point of the spiral groove (41). In the first suction-side area (45), a length $L_1$ in a direction along the spiral groove (41) is approximately 10-40 mm (e.g., 20 mm), and a depth $D_1$ at the start point of the spiral groove (41) is approximately 1-3 mm (e.g., 1 mm).

Figure 11:
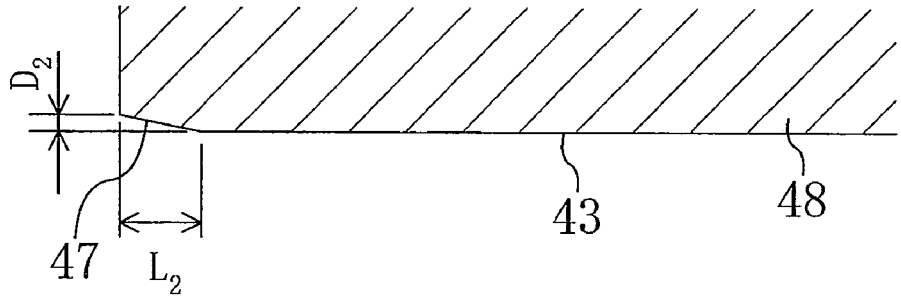
FIG. 11 is another cross-sectional view illustrating the main part of the wall portion of the screw rotor of Modified Example 1 of the embodiment.

In the screw rotor (40) illustrated in FIG. 9, the second suction-side area (47) is formed so that its depth gradually becomes deeper toward the start point of the spiral groove (41). A shape of the second suction-side area (47) will be described in detail with reference to FIG. 11. FIG. 11 illustrates a development view of a cross section of the wall portion (48) of the screw rotor (40) in the circumferential direction of the screw rotor (40). The second suction-side area (47) illustrated in FIG. 11 has an inclined surface where the surface is inclined at a certain rate toward the start point of the spiral groove (41). In the second suction-side area (47), a length $L_2$ in the direction along the spiral groove (41) is approximately 1-5 mm (e.g., 3 mm), and a depth $D_2$ at the start point of the spiral groove (41) is less than or equal to 1 mm (e.g., 0.5 mm). As described above, the second suction-side area (47) is formed by chamfering the corner positioned at the start point of the second side wall surface (43) in the wall portion (48) of the screw rotor (40).

In the screw compressor (1) of the present modified example including the screw rotor (40) illustrated in FIG. 9, the clearance between the first suction-side area (45) of the first side wall surface (42) and the gate (51) is wider closer to the start point of the spiral groove (41). In addition, a clearance between the second suction-side area (47) of the second side wall surface (43) and the gate (51) is wider closer to the start point of the spiral groove (41). Thus, in the course of the entrance of the gate (51) into the start point of the spiral groove (41), even if a relative position between the spiral groove (41) and the gate (51) does not exactly match a design value, the gate (51) can smoothly enter the spiral groove (41). Consequently, this prevents the gate (51) from being damaged or worn out by being stuck when entering the spiral groove (41), thereby improving reliability of the screw compressor (1).

Similarly, as in the above-described embodiment, the screw rotor (40) of the present modified example illustrated in FIG. 9 is also processed by using the 5-axis machining center (100). In the 5-axis machining center (100), the traveling path (tool path) of the cutting tool (110) in the finish processing is set so that both of the first suction-side area (45) and the second suction-side area (47) are formed in the work (120) to be the screw rotor (40). Thus, once the work (120) to be the screw rotor (40) is attached to the 5-axis machining center (100), the processing of the spiral groove (41) can be completed without detaching the work (120) from the 5-axis machining center (100).

Modified Example 2 of the Embodiment

In the screw compressor (1) of the above-described embodiment, the second suction-side area (47) described in Modified Example 1 may be formed in the screw rotor (40) in addition to the first suction-side area (45) and the third suction-side area (46). That is, as illustrated in FIG. 12, in each spiral groove (41) formed in the screw rotor (40) of the present modified example, the first suction-side area (45), the second suction-side area (47), and the third suction-side area (46) are formed in the first side wall surface (42), the second side wall surface (43), and the bottom wall surface (44), respectively.

Figure 12:
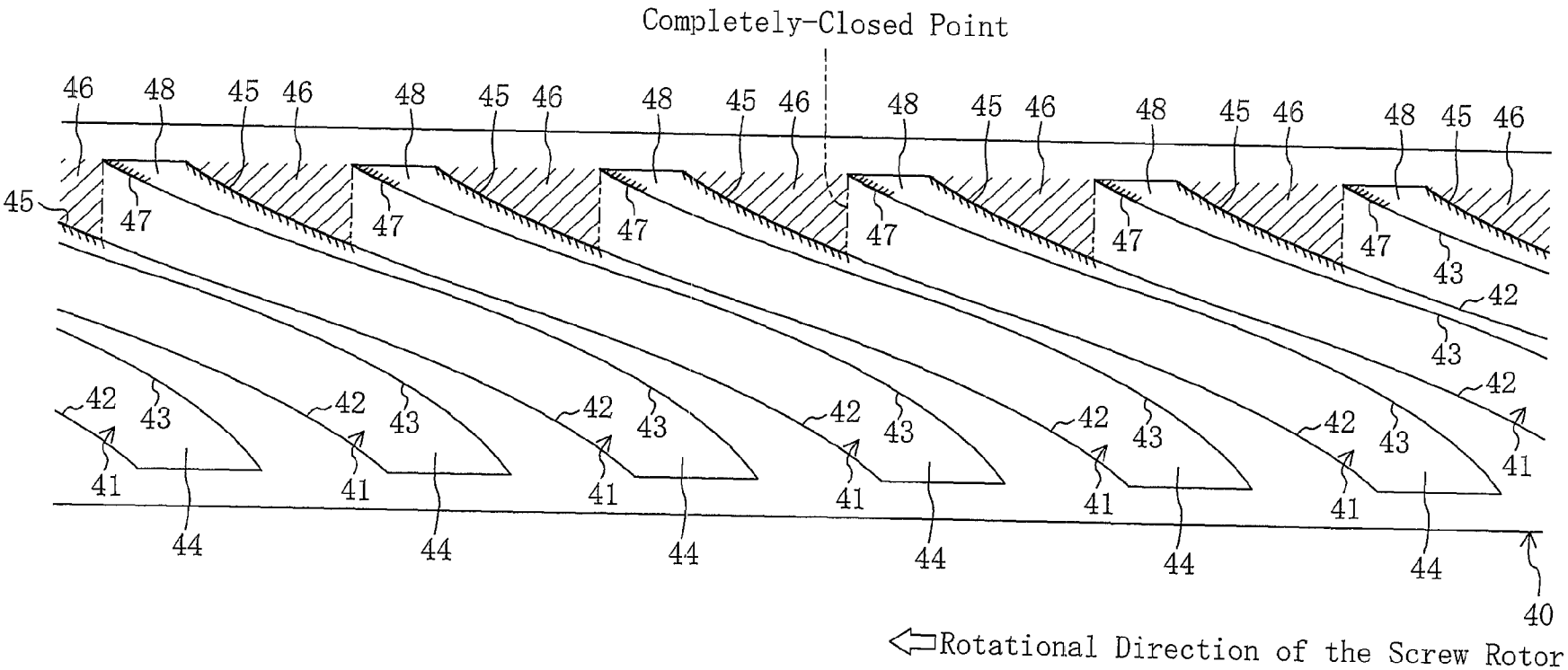
FIG. 12 is a development view of a screw rotor of Modified Example 2 of the embodiment.
Figure 13:
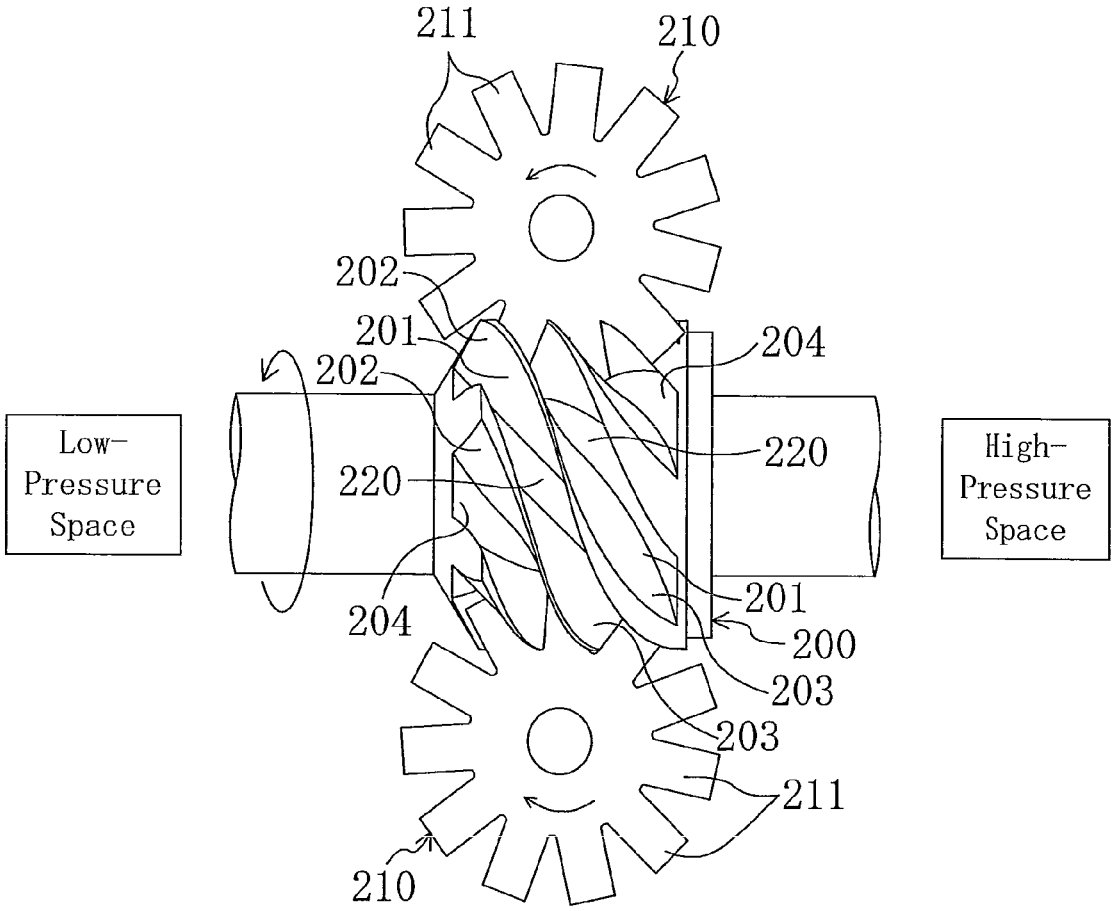
FIG. 13 is a plan view illustrating a structure of a main part of a conventional single screw compressor.

Similarly, as in the above-described embodiment, the screw rotor (40) of the present modified example illustrated in FIG. 12 is also processed by using the 5-axis machining center (100). In the 5-axis machining center (100), the traveling path (tool path) of the cutting tool (110) in the finish processing is set so that all of the first suction-side area (45), second suction-side area (47), and the third suction-side area (46) are formed in the work (120) to be the screw rotor (40). Thus, once the work (120) to be the screw rotor (40) is attached to the 5-axis machining center (100), the processing of the spiral groove (41) can be completed without detaching the work (120) from the 5-axis machining center (100).

Modified Example 3 of the Embodiment

In the screw compressor (1) of the above-described embodiment, the shaft (58) of the rotor support (55) is arranged only on the back side of the gate rotor (50), and the ball bearings (92, 93) for supporting the shaft (58) are also arranged only on the back side of the gate rotor (50). On the other hand, the shaft (58) of the rotor support (55) may be arranged so as to penetrate through the gate rotor (50), and each of the ball bearings (or roller bearings) for supporting the shaft (58) may be arranged on the front and back sides of the gate rotor (50).

The above-described embodiments are provided as preferable examples, and is not intended to limit the present invention, objects to which the present invention is applied, or use thereof.

INDUSTRIAL APPLICABILITY

As described above, the present invention is useful in a single screw compressor.

The invention claimed is:

1. A single screw compressor comprising:

a screw rotor (40) formed with a plurality of spiral grooves (41) in an outer circumference;

a casing (10) in which the screw rotor (40) is accommodated; and gate rotors (50) with a plurality of radially-formed gates (51) to be engaged with the spiral grooves (41) of the screw rotor (40), wherein the single screw compressor compresses fluid in a compression chamber (23) defined by the screw rotor (40), the casing (10), and the gate (51), by relatively moving the gate (51) from a start point to a terminal point in the spiral groove (41); and a first side wall surface (42) of a pair of side wall surfaces of the spiral groove (41) of the screw rotor (40), which is positioned on a front side in a traveling direction of the gate (51) is formed with a first suction-side area (45) where a portion of the first side wall surface (42), which extends from the start point to a point immediately before the compression chamber (23) is completely closed, is partially removed so as not to entirely contact a side surface of the gate (51).

2. The single screw compressor of claim 1, wherein the depth of the first suction-side area (45) gradually becomes deeper toward the start point of the spiral groove (41).

3. The single screw compressor of claim 2, wherein a second side wall surface (43) of a pair of the side wall surfaces of the spiral groove (41) of the screw rotor (40), which is positioned on a rear side in the traveling direction of the gate (51), is formed with a second suction-side area (47) where a start-point portion of the second side wall surface (43) is partially removed; and the depth of the second suction-side area (47) gradually becomes deeper toward the start point of the spiral groove (41).

4. The single screw compressor of claim 3, wherein the depth of the first suction-side area (45) at the start point of the spiral groove (41) is deeper than that of the second suction-side area (47) at the start point of the spiral groove (41).

5. The single screw compressor of any one of claims 1 to 4, wherein a bottom wall surface (44) of the spiral groove (41) of the screw rotor (40) is formed with a third suction-side area (46) where a portion of the bottom wall surface (44), which extends from the start point to the point immediately before the compression chamber (23) is completely closed, is partially removed so as not to entirely contact a tip end surface of the gate (51).

6. A method for processing the screw rotor of the single screw compressor of claim 1, wherein, when cutting a work (120) to be the screw rotor by a 5-axis machining center (100), a traveling path of a cutting tool (110) in a finish processing which uses the 5-axis machining center (100) is set so that the first suction-side area (45) is formed in the first side wall surface (42) of the spiral groove (41).

* * * * *